United States Patent [19]

Schmidlin et al.

[11] Patent Number: 5,047,003

[45] Date of Patent: Sep. 10, 1991

[54] APPARATUS FOR ZIGZAG FOLDING A PAPER WEB

[75] Inventors: Werner Schmidlin, Frick; Edwin Straub, Oftringen, both of Switzerland

[73] Assignee: Faltex AG, Wohlen, Switzerland

[21] Appl. No.: 464,454

[22] Filed: Jan. 12, 1990

[30] Foreign Application Priority Data

Jan. 25, 1989 [CH] Switzerland ..... 00223/89

[51] Int. Cl.[5] ..... B65H 45/101; B65H 45/20

[52] U.S. Cl. ..... 493/413; 493/419

[58] Field of Search ..... 493/23, 413, 414, 419, 493/420, 421

[56] References Cited

U.S. PATENT DOCUMENTS

| | | | |
|---|---|---|---|
| 3,712,610 | 1/1973 | Garrone | 493/413 |
| 3,724,838 | 4/1973 | Orlovsky | 493/413 |
| 3,747,917 | 7/1973 | Roda | 493/419 |
| 4,109,902 | 8/1978 | Barrer | 493/444 |
| 4,484,905 | 11/1984 | Ashburner | 493/415 |
| 4,601,695 | 7/1986 | Pazzi | 493/419 |

FOREIGN PATENT DOCUMENTS

| | | |
|---|---|---|
| 1934292 | 1/1971 | Fed. Rep. of Germany . |
| 1349558 | 3/1972 | United Kingdom . |

*Primary Examiner*—William E. Terrell

*Attorney, Agent, or Firm*—Collard, Roe & Galgano

[57] ABSTRACT

A folding apparatus for zigzag folding a paper web with a cylinder driven in rotation alternately in one direction and the other. Two folding rollers are biased against the cylinder. A return stop is provided in the end region of the paper web feed. Two jointly pivotal guide members having guide rails arranged in the manner of a rake with free ends being directed towards one another are located upstream of the cylinder. In the lower end position, the guide rails of the upper guide member project into the built-up space defined between the folding rollers and the rotatable cylinder. The upper guide member, together with the lower folding roller, delimit a guide passage for the paper web. In the upper end position, the guide passage for the paper web is formed by the upper folding roller and the guide rails of the lower guide member.

12 Claims, 3 Drawing Sheets

APPARATUS FOR ZIGZAG FOLDING A PAPER WEB

The present invention relates to apparatus for the zigzag folding of a paper web.

An apparatus for zigzag folding a paper web is disclosed in German Patent 2,134,898. According to the apparatus disclosed in this German patent, the paper web to be folded is guided in a plane approximately at right angles to a rotating surface, through the return stop provided in the feed and up against the rotating surface As the leading edge of the paper web comes to bear on the rotating surface, the leading edge region of the paper web is deflected in the direction of rotation and fed to a first folding nip formed between the rotating surface and a folding roller. Symmetrically arranged to this first folding roller in relation to the plane of the guided paper web, there is a second folding roller which likewise forms a folding nip together with the rotating surface. By driving the rotating surface alternately in one direction and then the other, after each reversal of direction, the paper web, being prevented by means of the return stop from running back counter to the feed direction, is bulged in the region between the rotating surface and the two folding rollers and introduced into the folding nip, at the front in the direction of rotation, to form a new fold. After the last fold has been formed, the rotating surface is driven further in the same direction of rotation, in order to convey the folded paper web out of the corresponding folding nip.

Although, in this known apparatus, the paper web is aligned with its lateral edge against a fence before being introduced to the apparatus, this does not guarantee that the paper web will be drawn straight into the first folding nip. Therefore, the subsequent folds may not be exactly at right angles to the lateral edge of the paper web. It is possible that the leading edge of the paper web is deformed, for example as a result of a varying degree of moisture or by being supported on rollers, and will consequently not be grasped and drawn into the folding nip simultaneously by the rotating surface and the respective folding roller along the entire width of the paper web. As a result of this, there may be an uneven pull on the paper web on one side, so that its longitudinal direction will no longer extend exactly in the feed direction. In particular, it becomes very difficult to introduce the paper web, front edge on, into the upwardly directed folding nip, since the dead weight of the paper web opposes this. Furthermore, in this patented apparatus, problems can arise when, during the last reversal of direction of the rotating surface, the trailing edge of the paper web comes to rest in the region between the return stop and the folding nip which is last active. At the same time, after the reversal of direction, the paper web can, under some circumstances, move back as far as the return stop, and this can lead to a fold whose position is not exactly defined and which may even run at a pronounced inclination. If, at the last reversal of direction, the trailing edge of the paper web is located in the region between the folding nip and the region of least distance between the two folding rollers, it is possible that, after the reversal of direction has taken place, the trailing edge of the web will run ahead into the respective folding nip without difficulty. It is also possible, however, especially when the end portion of the paper web is deformed in the direction counter to the feed direction, that a further uncontrollable folding or ear formation will occur. In view of the two lastmentioned problems in the patented device, the end of the paper web is monitored so as to prevent the last reversal of direction by means of a control. The disadvantage of this is first that the folded paper web cannot be conveyed out of the apparatus in any direction and second that, when the distance between successive folds is small, after the last fold there remains an end portion of the paper web which is longer than the distance between two adjacent folds, so that a final fold must also be made subsequently by hand.

It is, therefore, an object of the present invention to provide an apparatus for zigzag folding a paper web which overcomes the problems described above in connection with prior art apparatus for zigzag folding of paper webs.

The above object is accomplished in accordance with the present invention by an apparatus for zigzag folding a paper web consisting of a web feed including a return stop, two folding nips arranged downstream of the web feed on each side of the plane of the paper web feed and formed by a rotatable surface driven alternately in one direction and then the other and a respective folding roller, and two mutually parallel guide members each associated with a folding nip. The guide members are disposed upstream of and proximate to the rotatable surface and, immediately after reversal of the rotatable surface, the guide members are displaceable in the direction of rotation towards a position wherein the guide member towards the rear in the direction of rotation and the forward folding roller define a slit-shaped passage for the paper web.

The passage formed by the guide member and the folding roller aligns the leading edge portion of the paper web over its entire width and introduces the leading edge of the paper web specifically into a first folding nip. Each guide member forms, together with its respective folding roller, a guide channel in which the paper web is guided until it enters the folding nip. It is thus also directly possible to introduce the paper web with its leading edge into a first upwardly directed folding nip. At each reversal of direction of the drive, the guide members are displaced in the respective direction of rotation of the rotatable surface towards the other end position. The bulged portion of the paper web, guided specifically, is thereby brought into the region of entry to the next folding nip, thus increasing the folding accuracy.

If, at a reversal of direction of the rotatable surface, the trailing edge of the paper web is located in the region between the guide member and the return stop, a final fold extending exactly at right angles to the lateral edge is made, since the guide member at the rear in the direction of rotation brings the end portion of the paper web, guided over its entire width, into the region of entry to the particular folding nip. If the trailing edge of the paper web is located in the region between a folding nip and the guide member before a reversal of direction, the formation of a further fold or an ear is forestalled, since the passage prevents the rear edge portion of the paper web from bending out in the direction counter to the feed. In a corresponding way, the guide members guarantee an exact and complete folding of a paper web with a small distance between adjacent foldings.

Because of the narrowed passage, that portion of the paper web coming from the feed and also that portion of the paper web located between the rotatable surface and a guide member are thus guided accurately.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
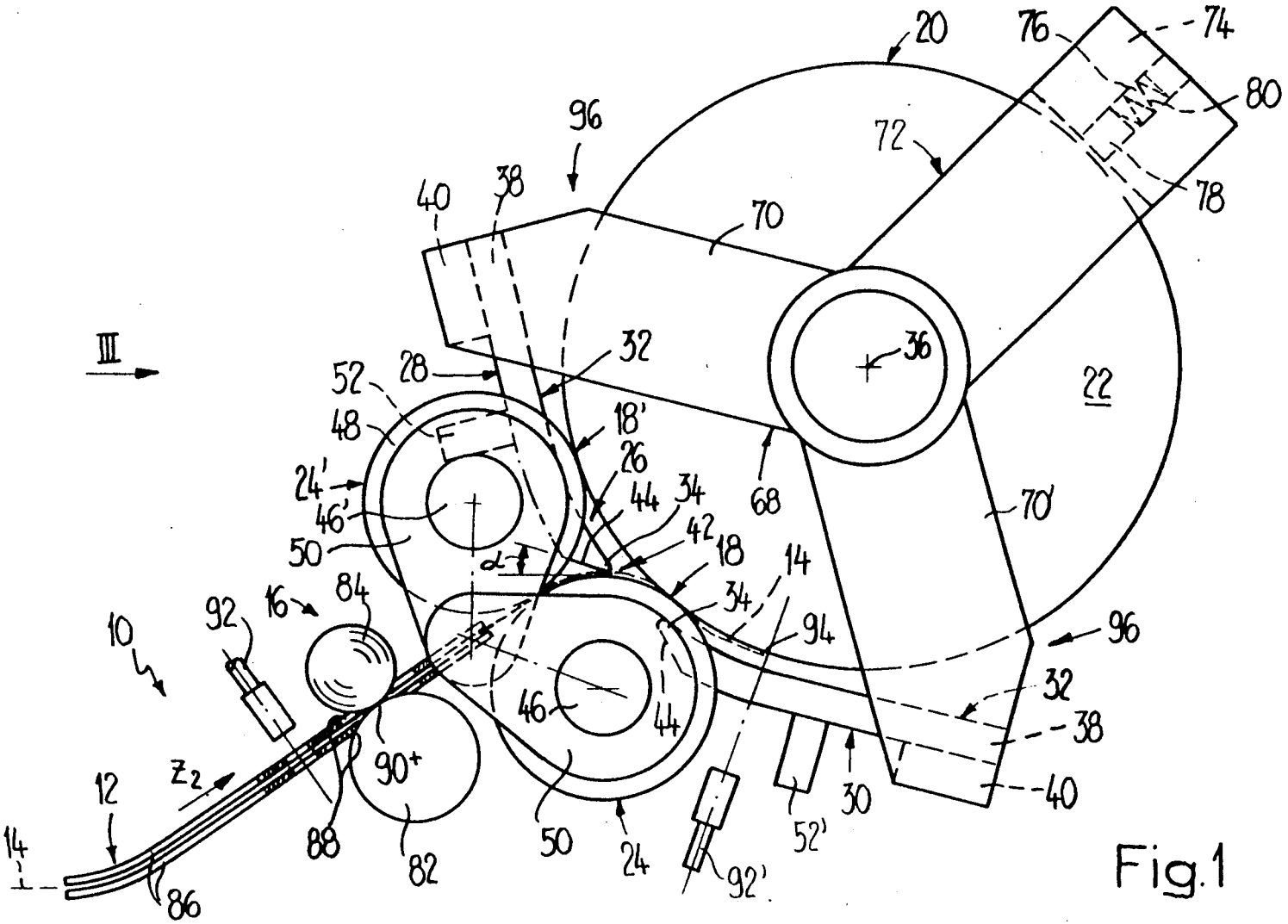
FIG. 1 is a schematic side elevational view of the apparatus for zigzag folding a paper web according to the present invention.

Now turning to the drawings, the folding apparatus has a feed 10 with a feed channel 12 for paper web 14 (shown in phantom). As seen in feed direction Z, a return stop 16 is arranged at the end of feed channel 12. Downstream from the end of feed channel 12, there are folding nips 18 and 18' arranged respectively on one side of return stop 16 and on the other side or on opposite sides of the plane defined by paper web 14 in feed 10. Lower folding nip 18 and upper folding nip 18' are formed by surface 20 of a rotatably mounted cylinder 22 and respective lower and upper folding rollers 24 and 24' against surface 20. Cylinder 22 is rotatably driven alternately in one direction and then the other by means of an appropriate drive (not shown). The end region of feed channel 12 extends approximately in the radial direction in relation to cylinder 22, and the two folding rollers 24 and 24' are approximately symmetrically arranged with respect to the plane defined by the end region of feed channel 12. In the region between folding nips 18 and 18', drive cylinder 22 and folding rollers 24 and 24', a built-up space, designated by reference numeral 26, is defined. Upper and lower guide members, designated 28 and 30, have several mutually parallel guide rails 32 spaced from one another in the axial direction of cylinder 22 and arranged in the manner of a rake. The oppositely directed free ends 34 of guide rails 32 of guide members 28 and 30 are spaced from one another and are each located on a line running parallel to the axis of rotation 36 of cylinder 22. The respective guide rails 32 of guide members 28 and 30 are fastened to an axially extending carrier 40 at their ends 38 facing away from free ends 34.

As further described below, guide members 28 and 30 can be simultaneously brought from a lower end position shown in FIGS. 1 and 3 into an upper end position shown in FIG. 2 and back again. In the lower end position, guide rails 32 of upper guide member 28 project into space 26, and the free ends 34 delimit, together with lower folding roller 24, a passage 42 for paper web 14, as clearly seen in FIG. 1. In this lower end position, guide rails 32 of lower guide member 30 are removed from space 26.

Figure 2:
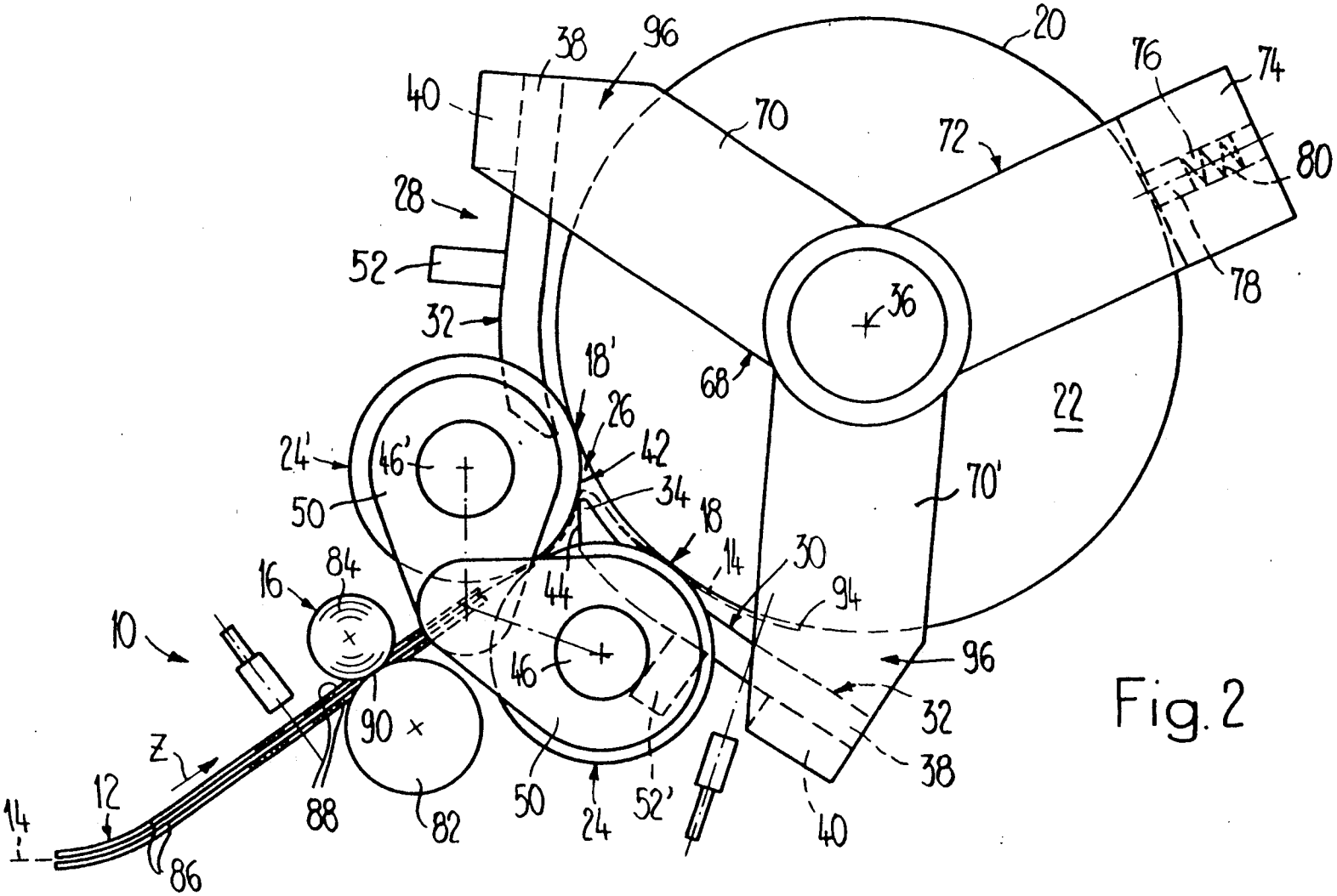
FIG. 2 is a view of the apparatus according to the present invention identical to FIG. 1, shown in a different stage.

In the upper end position, shown in FIG. 2 of guide members 28 and 30, guide rails 32 of upper guide member 28 are removed from space 26, and the guide passage 42 is now formed by upper folding roller 24' and free ends 34 of guide rails 32 of lower guide member 30 which now reach into space 26. As clearly seen in FIG. 1, guide rails 32, in their free end regions, are curved and extend approximately coaxially relative to cylinder 22 and, on the side facing away from cylinder 22 and facing web feed 10, have guide faces 44 which from an acute angle c together with a line tangent to the outer surfaces of folding rollers 24 and 24' with which they form narrow guide passage 42 for paper web 14. In the region between the end of feed channel 12 and guide passage 42, the two folding rollers 24 and 24' and the respective guide faces 44 form a channel-like guide for paper web 14.

Figure 3:
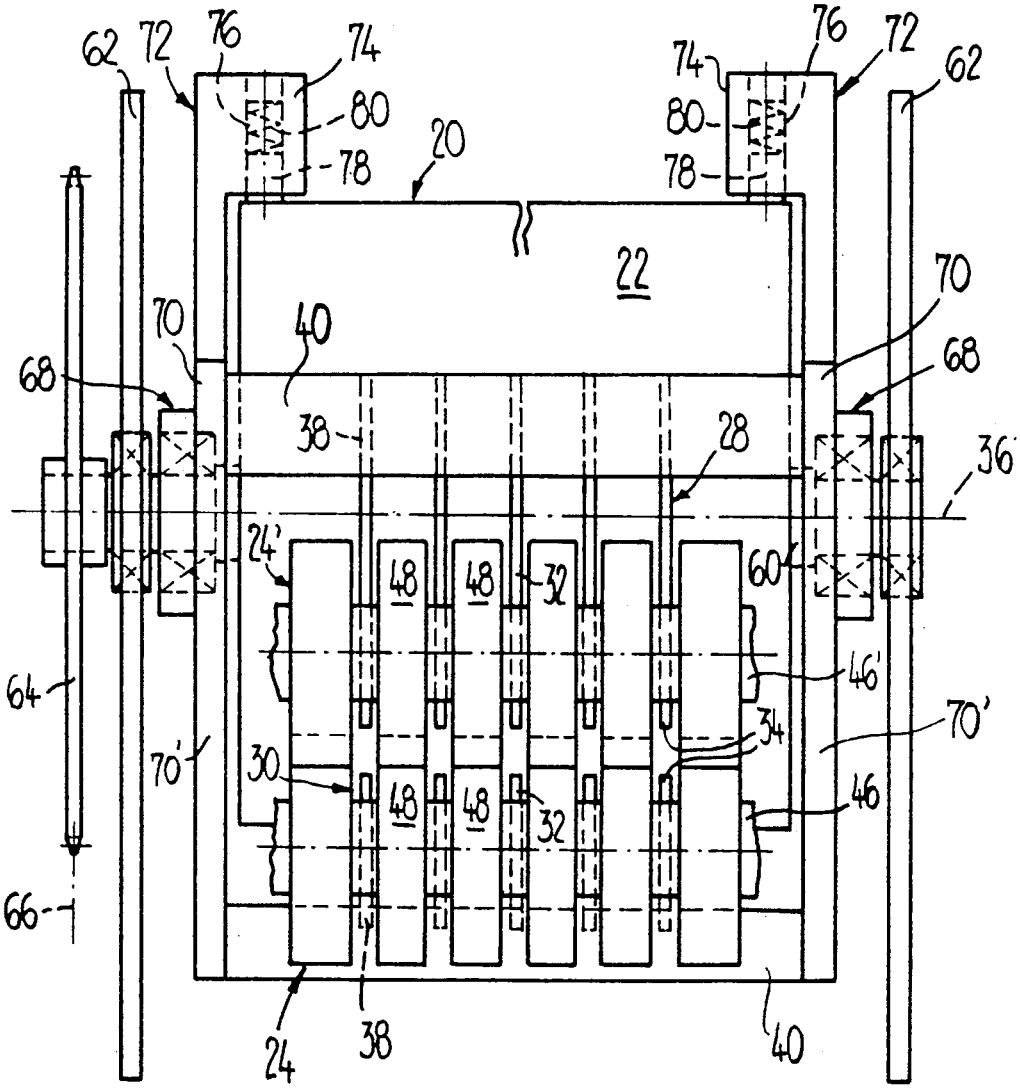
FIG. 3 is a view of the apparatus according to the present invention from the direction designated III in FIG. 1, without the paper web feed.

As can be clearly seen in FIG. 3, each folding roller 24 and 24' has several rollers 48 which are freely rotatably mounted on respective folding-roller shafts 46 and 46' and are spaced from one another in the axial direction and between which in each case the guide rails 32 are guided. At the same time, guide rails 32 run between cylinder 22 and the respective folding-roller shaft 46 or 46'. The folding roller shafts 46 and 46' are arranged on pivoting levers 50 which are biased towards cylinder 22, as seen in FIGS. 1 and 2. On at least one guide rail 32 of each guide member 28 and 30 there is a limit stop projection 52 and 52', respectively, which projects outward approximately in the radial direction in relation to cylinder 22 and which, together with the respective folding-roller shaft 46 or 46', defines the particular end position of guide members 28 and 30. In the lower end position shown in FIG. 1, limit stop projection 52 of upper guide member 28 rests against folding-roller shaft 46' of upper folding roller 24', and in the upper end position shown in FIG. 2 limit stop projection 52' of lower guide member 30 is supported on folding-roller shaft 46 of lower folding roller 24.

As also clearly seen in FIG. 3, cylinder 22 is fixedly located in terms of rotation on a rotary shaft 60 which is freely rotatably mounted on lateral bearing plates 62. Likewise fixedly located in terms of rotation on shaft 60 is a chain wheel 64 which is connected to the drive for cylinder 22 by means of a chain 66 shown in phantom. On both sides of cylinder 22, in the region between the cylinder and the respective bearing plate 62, a holding member 68 is mounted freely rotatable on shaft 60. Each holding member 68 has three radially extending holding arms 70, 70' and 72 which are offset approximately 120° relative to one another and the free ends of which project beyond cylinder 22 in the radial direction. Folding rollers 24 and 24' and web feed 10 are arranged in the region between holding arms 70 and 70', and fastened to the end regions of the latter are carriers 40 for guide rails 32 of guide members 28 and 30. Holding arms 72, in their end regions, have extensions 74 which are directed towards one another and which project into the region of cylinder 22. Formed on extensions 74 are radially extending recesses 76, in each of which is guided a friction shoe 78 which is biased against surface 20 of cylinder 22 by means of a spring 80.

During rotation of cylinder 22 in the anticlockwise direction, holding members 68 are taken up as a result of the friction between friction shoes 78 and surface 20, until limit stop 52 of upper guide member 28 rests against folding-roller shaft 46'. As soon as the thus defined lower end position of guide members 28 and 30 is reached, friction shoes 78 slide on surface 20 of the further-rotating cylinder 22, thereby ensuring that guide members 28 and 30 remain in the lower end position. In contrast, when cylinder 22 is driven in the clockwise direction, holding members 68 are also taken up in the clockwise direction, until limit stop 52' of lower guide member 30 rests against folding-roller shaft 46. During the further rotation of cylinder 22 in the clockwise direction, the upper end position of guide members 28 and 30 is preserved as a result of the friction between friction shoes 78 and surface 20 of cylinder 22.

Return stop 16 has several conveying rollers 82 arranged adjacent to one another, of which only one is seen in FIGS. 1 and 2 and which are connected to a free-wheel active in feed direction Z. Located opposite conveying rollers 82 in relation to feed channel 12 are freely rotatably mounted balls 84 which are biased towards conveying rollers 82. Feed channel 12 is delimited by mutually parallel upper and lower guide plates 86 which have recesses 88 for conveying rollers 82 and balls 84 in the region of return stop 16. Conveying rollers 82 and balls 84 form a conveying nip 90 for paper web 14 guided in feed channel 12. Conveying rollers 82 are driven in order to introduce paper web 14 into the folding apparatus. As soon as the leading edge of paper web 14 is introduced into the first folding nip 18, conveying rollers 82 are no longer driven and act only as a return stop for paper web 14.

Sensors 92 and 92' are provided, one upstream from return stop 16 and the other downstream from first folding nip 18, and are connected to a control device (not shown) controlling the drive for cylinder 22 and the drive for conveying rollers 82. These sensors 92 and 92', for example photoelectric cells, respectively transmit a signal when leading edge 94 of paper web 14 runs by them. In FIG. 1, leading edge 94 of paper web 14 is located in the region of second sensor 92'.

It may also be mentioned, for the sake of completeness, that guide rails 32, together with surface 20 of cylinder 22, each form a guide channel 96 for paper web 14 on the side located opposite built-up space 26 in relation to respective folding nip 18 and 18'.

In operation, the folding apparatus functions as follows: On a table (not shown) upstream of feed 10, paper web 14 to be folded is aligned with its lateral edge against a guide fence, as known, for example, from German Patent 2,134,898. Paper web 14 is then introduced into feed channel 12 in feed direction Z. As soon as sensor 92 detects the leading edge 94 of paper web 14, the drive for cylinder 22, is set in motion, the latter being driven in the anticlockwise direction. At the same time, holding members 68 are likewise taken up in the anticlockwise direction and guide members 28 and 30 are pivoted into the lower end position shown in FIG. 1. Conveying rollers 82 are likewise driven in feed direction Z to further advance paper web 14. As leading edge 94 enters conveying nip 90, conveying rollers 82 and balls 84 grasp paper web 14 and convey it further in feed direction Z automatically. Leading edge 94 thereby enters the region between the two folding rollers 24 and 24' and in the built-up space 26 is introduced over its entire width into narrow guide passage 42 by means of guide faces 44 of guide rails 32. In this case, guide passage 42 is formed by upper guide member 28, the guide member located to the rear in the direction of rotation of cylinder 22, and by lower folding roller 24, the folding roller located to the front in the direction of rotation of cylinder 22. The introduction of paper web 14 into slit-shaped narrow guide passage 42 is facilitated because of acute angle $\alpha$ formed by guide face 44 and lower folding roller 24. The leading edge portion of paper web 14 is deflected towards first folding nip 18 by guide faces 44. The leading edge portion of paper web 14 is grasped by surface 20 and lower folding roller 24 and conveyed towards guide channel 96 between surface 20 and guide rails 32 of lower guide member 30. As soon as leading edge 94 reaches sensor 92', the latter transmits a signal to the control device, as a result of which the drive for conveying rollers 82 is switched off and a folding program is started. This folding program now predetermines for the drive of cylinder 22 how far the latter is to be driven in one direction of rotation and the other.

As a result of the further rotation of cylinder 22 in the anticlockwise direction, paper web 14 is drawn further, conveying rollers 82 co-rotating freely, since the respective free-wheel is active.

When the direction is to be reversed, cylinder 22 is braked and subsequently driven in the clockwise direction. As a result of this new direction of rotation of surface 20, paper web 14 is pushed counter to feed direction Z. However, return stop 16 prevents paper web 14 from moving back. That portion of the paper web 14 located in the space 26 is thereby bulged in the direction of folding nip 18'. When cylinder 22 begins to rotate in the clockwise direction, holding members 68 are also taken up as a result of friction between surface 20 and friction shoes 78, in order to pivot guide members 28 and 30 into the upper end position shown in FIG. 2. In this case, guide passage 42 is formed by lower guide member 30 which is the guide member located towards the rear in the direction of rotation of cylinder 22 and by upper folding roller 24' which the folding roller located towards the front in the direction of rotation of cylinder 22. As a result of the associated pivoting of guide rails 32 of lower guide member 30 into space 26, the bulge of paper web 14 is guided specifically towards upper folding nip 18', and because of the inherent stiffness of paper web 14 those portions of paper web 14 located on both sides of free ends 34 are laid for take-up against surface 20 and upper folding roller 24'. The portion of paper web 14 bulged in this way enters folding nip 18', where paper web 14 is folded a first time. As a result of the further rotation of cylinder 22 in the clockwise direction, paper web 14 is drawn further through web feed 10, and those portions of paper web 14 adjacent to the formed fold on both sides are laid against one another and, with the fold in front, conveyed into upper guide channel 96 between surface 20 and guide rails 32 of upper guide member 30.

During a subsequent reversal of direction, guide members 28 and 30 are once again pivoted into the lower end position and paper web 14 is folded a further time in a similar way. This operation is repeated alternately, until the entire paper web 14 is zigzag folded in concertina fashion.

For conveying the ready-folded paper web 14 out of the folding apparatus through lower guide channel 96, cylinder 22 is driven in the anticlockwise direction. If, after the last fold has been made, ready-folded paper web 14 is located in the region of upper folding nip 18' and guide channel 96, then as a result of the pivoting of guide members 28 and 30 into the lower end position the part of folded paper web 14 now leading, as seen in the direction of rotation, is guided, in the region of space 26, towards lower folding nip 18 by guide rails 32 of upper guide member 28. This prevents the formation of ears or the renewed bending round of the end region of paper web 14, even if the end of paper web 14 is thereby pushed towards folding nip 18 and not pulled.

If, after a reversal of direction of cylinder 22, the end of paper web 14 is located in the region between guide members 28 and 30 and return stop 16, then as a result of the pivoting of the guide members 28 and 30 it becomes possible to form a final fold extending parallel to the folds already made, despite the possible backward movement of the end portion of paper web 14 counter to feed direction Z.

As a result of the formation of a narrow guide passage 42 in the two end positions of guide members 28 and 30, it is now also easily possible to introduce paper web 14 directly into upper folding nip 18, since it is guided in the region of space 26. Of course, it is also possible for the ready-folded paper web 14 to be guided out through upper guide channel 96. For this, cylinder 22 is driven in the clockwise direction.

Folding rollers 24 and 24' can be produced in one piece and with continuous grooves, through which guide rails 32 are guided. Of course, the limit stops and counterstops for determining the two end positions of guide members 28 and 30 can be provided at other locations. It is also possible for conveying rollers 82 not to be driven. Thus, paper web 14 to be folded must be pushed forward by hand until the leading edge region enters a folding nip 18 or 18'. It is also possible for conveying rollers 82 to be driven continuously in feed direction Z. In this case, guide members 28 and 30 exert their full effect only during the introduction of paper web 14 to be folded and for guiding the ready-folded paper web 14 out of the folding apparatus.

While only a single embodiment of the present invention has been shown and described, it will be obvious that many changes and modifications may be made thereunto without departing from the spirit and scope of the invention.

What is claimed is:

1. Apparatus for the zigzag folding of a paper web, comprising:

a) a feed for the paper web;

b) a return stop arranged at the downstream end of said paper web feed;

c) two folding nips downstream of said paper web feed arranged on opposing sides of the plane of the paper web feed and formed by a rotatable surface adapted to be driven alternately in one direction and then the other, and two folding rollers, each being arranged in association with a respective folding nip, and rotatable surface and said two folding rollers cooperatively defining a build-up space therebetween, d) means for rotating said surface alternately in one direction and then the other; and e) two spaced apart guide members, each being associated with a respective folding nip, disposed upstream of and proximate to the rotatable surface, said guide members being adapted for displacement in the direction of rotation for the rotatable surface to an end position immediately following reversal of direction of the rotatable surface; and;

f) means for displacing said guide members in the direction of rotation of said surface from a first end position outside the build-up space into a second end position inside the build-up space immediately following the respective reversal of the driving direction of the rotatable surface, said guide members being spaced from said nips in the second position; and g) a slit-shaped guide passage for the paper web leading to the respective folding nip and formed between the guide member positioned to the rear in the direction of rotation of the rotatable surface and the folding roller positioned to the front in the direction of rotation of the rotatable surface.

2. The apparatus as claimed in claim 1, wherein the guide members have guide rails extending substantially in the direction of rotation arranged in the manner of a rake and on which are formed, at ends directed towards one another, guide faces which form an acute angle with the respective folding roller delimiting said slit-like guide passage.

3. The apparatus as claimed in claim 2, wherein each folding roller is formed by coaxial spaced apart rollers located on a common shaft, and said guide rails are guided in the spaces between the rollers.

4. The apparatus as claimed in claim 2, wherein each folding roller is provided with continuous circumferential grooves, and said guide rails are guided through said grooves.

5. The apparatus as claimed in claim 1, wherein the guide members delimit, together with the rotatable surface, a guide channel downstream from the respective folding nip.

6. The apparatus as claimed in claim 1, wherein the guide members are displaced from one end position to the other by frictional take-up means.

7. The apparatus as claimed in claim 6, wherein the rotatable surface is the outer surface of a cylinder mounted rotatably about its axis, and the guide members are arranged on a mounting mounted pivotally about said axis and which is provided with at least one friction shoe resting against said cylinder.

8. The apparatus as claimed in claim 1, wherein said guide members have two limit stops which interact alternately with two counterstops to determine the end positions.

9. The apparatus as claimed in claim 8, wherein said counterstops are provided on said respective folding rollers

10. The apparatus as claimed in claim 8, wherein said counterstops are provided on shafts for said respective folding rollers.

11. The apparatus as claimed in claim 1, wherein said return stop is formed as a conveying member only for introducing the paper web through the slit-shaped guide passage into a first folding nip.

12. Apparatus for the zigzag folding of a paper web, comprising:

a feed for the paper web;

a return stop arranged at the downstream end of said paper web feed;

two folding nips downstream of said paper web feed arranged on opposing sides of the plane of the paper web feed and formed by a rotatable surface adapted to be driven alternately in one direction and then the other, and;

two folding rollers, each being arranged in association with a respective folding nip, said rotatable surface and said two folding rollers cooperatively defining a build-up space therebetween;

means for rotating said surface alternately in one direction and then the other;

at least one rake-like guide member including a plurality of spaced-apart guide rails disposed upstream of, and proximate to, said rotatable surface, said guide rails extending substantially in the driving direction of said rotatable surface;

means for displaceably mounting said guide rails for displacement in the respective driving direction of said rotatable surface while introducing the leading edge of the paper web to be folded and while conveying out the folded web, from a first end position outside the build-up space into a second end position inside the build-up space immediately following the respective reversal of the driving direction of the rotatable surface, in the latter end position of which said guide rails cooperate with said folding roller positioned to the front in the driving direction of said rotatable surface to form a slit-like passage for the paper web; and said guide rails having end regions facing said folding roller positioned to the front and a side facing said paper web feed on which are formed guide faces which, together with said front-positioned folding roller, form an acute angle limiting said slit-like passage for introducing the leading edge of the fed paper web into the respective folding nip.

* * * * *